US008646775B2

(12) United States Patent
Endo

(10) Patent No.: US 8,646,775 B2
(45) Date of Patent: Feb. 11, 2014

(54) SHEET DETECTING APPARATUS AND IMAGE FORMING APPARATUS

(75) Inventor: Terutaka Endo, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 13/399,182

(22) Filed: Feb. 17, 2012

(65) Prior Publication Data

US 2012/0219337 A1 Aug. 30, 2012

(30) Foreign Application Priority Data

Feb. 25, 2011 (JP) ..... 2011-039354

(51) Int. Cl.
*B65H 7/02* (2006.01)

(52) U.S. Cl.
USPC .. 271/265.01; 271/264; 271/176; 271/258.01

(58) Field of Classification Search
USPC ..... 271/265.01, 264, 258.01, 176
See application file for complete search history.

(56) References Cited

U.S. PATENT DOCUMENTS 5,923,140 A 7/1999 Azumi et al.

FOREIGN PATENT DOCUMENTS

EP 0837019 A1 4/1998
JP 2007-297190 A 11/2007

*Primary Examiner* — Luis A Gonzalez
(74) *Attorney, Agent, or Firm* — Fitzpatrick, Cella, Harper & Scinto

(57) ABSTRACT

A sheet detecting apparatus includes a turning portion, a sensor outputting a detection signal in response to turning of the turning portion to the detecting position, a first sliding contact portion sliding in contact with the protruded portion so as to move relatively to the protruded portion in an axial direction of the turning portion when the turning portion returns from the detecting position to the home position, and a second sliding contact portion sliding in contact with the protruded portion so as to move relatively to the protruded portion in the axial direction of the turning portion when the turning portion turns from the home position to the detecting position.

8 Claims, 13 Drawing Sheets

SHEET DETECTING APPARATUS AND IMAGE FORMING APPARATUS

BACKGROUND OF THE INVENTION

1. Field of the Invention

The present invention relates to a sheet detecting apparatus and an image forming apparatus.

2. Description of the Related Art

Conventionally, as a method for confirming a conveyance position of a recording medium (sheet) in an apparatus, the recording medium, which is being conveyed, directly contacts and swings a sensor flag arranged in a conveyance path. Positional information of the recording medium is thereby detected from ON/OFF signal information of a sensor such as a photo interrupter. Such a method is generally known.

In such a contact-type sensing configuration, when the swung sensor flag returns to a standby position (hereinafter referred to as "a home position"), the sensor flag collides with an opposed positioning member. This may generate a harsh collision noise or a detection error caused by erroneous detection of the sensor due to bounce of the sensor flag, that is, chattering.

Also, by inclining the abutting surface of the sensor flag as in U.S. Pat. No. 5,923,140, or by forming the cross section of the receiving surface 501*a* with which the positioning abutting portion 1*d* of the sensor flag 1 collides, in a V shape as illustrated in FIGS. 13A and 13B, the chattering is reduced, and the detection error is improved. However, in the former case the inclined abutting surface of the sensor flag still abuts on the positioning member. And in the latter case illustrated in FIGS. 13A and 13B, the positioning abutting portion 1*d* of the sensor flag 1 collides with two inclined surfaces forming the cross-sectional V shape of the receiving surface 501*a*. Thus, kinetic energy of the sensor flag is converted into sound energy precipitously and is radiated outside as a collision noise, which generates an aurally harsh noise.

Also, in Japanese Patent Laid-Open No. 2007-297190, a sheet detecting lever has an abutting surface. After a sheet material passes, the sheet detecting lever is brought back from a retracting position while the sheet material is passing to an original position. At this time, the abutting surface abuts on another member to return to the original position. When the abutting surface of the sheet detecting lever slides in contact with the another member, the sheet detecting lever moves in an axial direction of the sheet detecting lever. A spring applies a force to the sheet detecting lever in an axial direction so that the abutting surface of the sheet detecting lever and the another member contact with each other at any time. Therefore the sheet detecting lever is hard to move.

The present invention reduces chattering of a sensor flag at a home position and alleviates a collision noise of the sensor flag with a simple configuration.

SUMMARY OF THE INVENTION

According to the present invention, a sheet detecting apparatus includes a turning portion turning from a home position to a detecting position by being pressed by a conveyed sheet and having a protruded portion protruded in a radial direction, a sensor outputting a detection signal in response to turning of the turning portion to the detecting position, a first sliding contact portion sliding in contact with the protruded portion so as to move relatively to the protruded portion in an axial direction of the turning portion when the turning portion returns from the detecting position to the home position, and a second sliding contact portion sliding in contact with the protruded portion so as to move relatively to the protruded portion in the axial direction of the turning portion when the turning portion turns from the home position to the detecting position.

Further features of the present invention will become apparent from the following description of exemplary embodiments with reference to the attached drawings.

BRIEF DESCRIPTION OF THE DRAWINGS

FIG. 9A illustrates a state in which the sensor flag is at the home position and FIG. 9B illustrates a state in which the sensor flag is at the detecting position;

DESCRIPTION OF THE EMBODIMENTS

An embodiment of a sheet detecting apparatus according to the present invention and an image forming apparatus having the same will be described specifically with reference to the drawings.

[First Embodiment]

First, a first embodiment of an image forming apparatus having a sheet detecting apparatus according to the present invention will be described with reference to FIGS. 1 to 6.

<Image Forming Apparatus>

Figure 1:
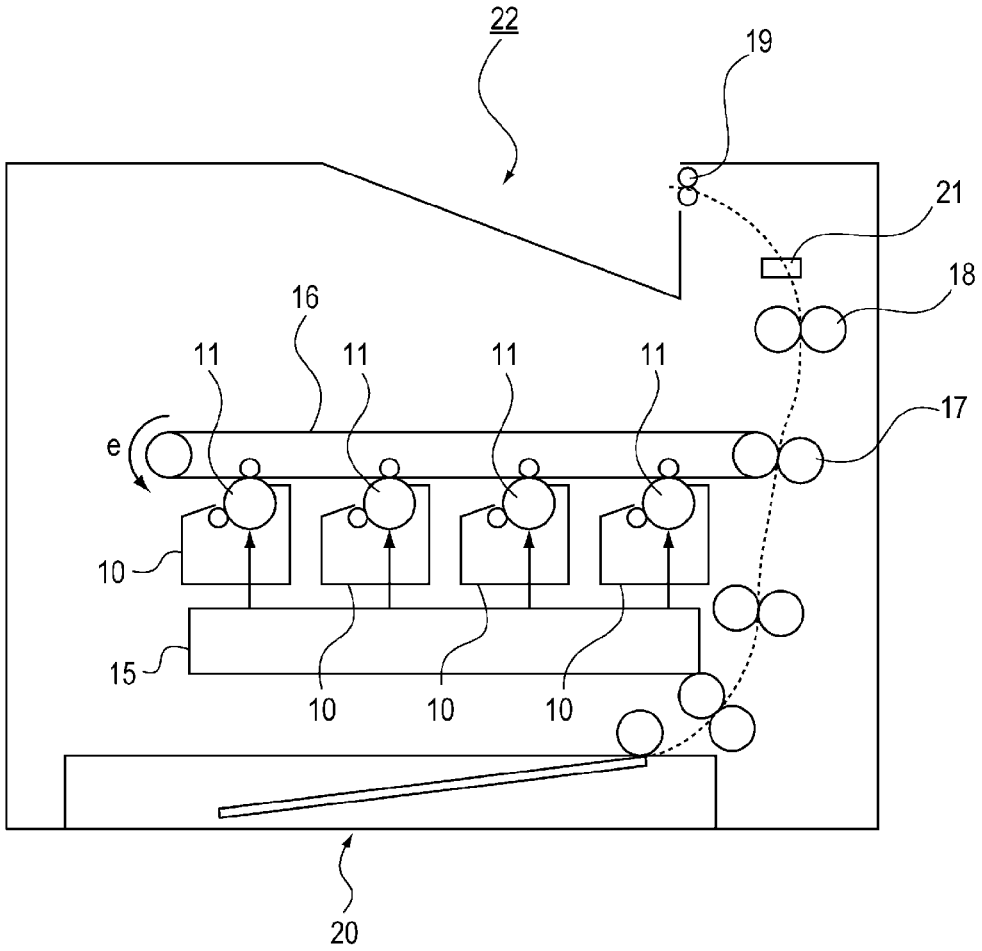
FIG. 1 is a cross-sectional view illustrating a configuration of an image forming apparatus having a sheet detecting apparatus according to the present invention.

FIG. 1 is a cross-sectional view illustrating an image forming apparatus 22 such as a printer having a sheet detecting apparatus 21 according to the present invention. This image forming apparatus 22 adopts a so-to-speak tandem system, in which four image forming units 10, each of which is an image forming portion to form an image with one of Y (yellow), M (magenta), C (cyan), and K (black) on a recording medium S as a sheet, are arranged in parallel in a horizontal direction.

Each of the image forming units 10 has a photosensitive drum 11, an electric charger, and a development device. From a laser scanning optical unit 15, a laser beam modulated based on image data is emitted to each photosensitive drum 11, and an electrostatic latent image is formed on the photosensitive drum 11. Directly above the image forming units 10, an intermediate transfer belt 16 is arranged so as to be rotatable in the arrow e direction in FIG. 1, and toner images formed on the respective photosensitive drums 11 are primarily transferred on the intermediate transfer belt 16 and are synthesized into a color image.

On the lower level of the image forming apparatus 22, a cassette feeding apparatus 20 housing the recording medium S is arranged. The recording medium S fed from the cassette feeding apparatus 20 is conveyed and nipped between the intermediate transfer belt 16 and a secondary transfer roller 17, and the toner images on the intermediate transfer belt 16 are secondarily transferred to the recording medium S. The recording medium S thereafter undergoes heat-fixing of the toner images at a fixing unit 18 and is discharged to an upper surface of the image forming apparatus 22 from a discharge roller 19. On a conveyance path between the fixing unit 18 and the discharge roller 19, the sheet detecting apparatus 21 is provided, to be described below in details, which detects the recording medium S conveyed on the conveyance path.

Meanwhile, in FIG. 1, the sheet detecting apparatus 21 is configured to detect the recording medium S on which the toner images have been fixed. A place to install the sheet detecting apparatus 21 is not limited as long as the place is on a conveyance path from a point at which the recording medium S is fed from the cassette feeding apparatus 20 to a point at which the recording medium S is discharged from the discharge roller 19.

<Sheet Detecting Apparatus>

Figure 2:
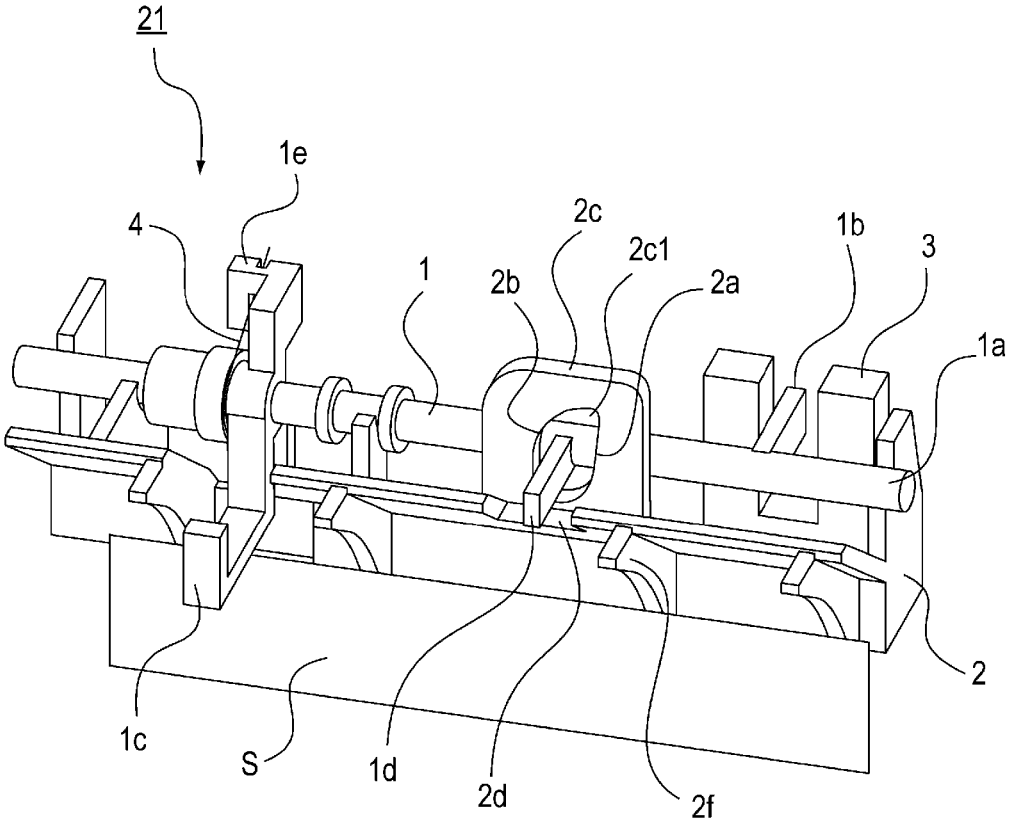
FIG. 2 is a perspective view illustrating a configuration of a first embodiment of the sheet detecting apparatus according to the present invention.

FIG. 2 illustrates a configuration of a first embodiment of a sheet detecting apparatus according to the present invention. In FIG. 2, in a conveying apparatus conveying the recording medium S such as a sheet, a conveying guide 2 guiding the conveyance of the recording medium S is provided. The conveying guide 2 is provided with a sensor flag 1 as a turning portion. The sensor flag 1 is supported to be rotatable by a not illustrated bearing member and to be movable in a direction along a rotation axis 1*a*. The sensor flag 1 contacts the recording medium S and is rotated and swung centering on the rotation axis 1*a* to detect a conveying state of the recording medium S. The sensor flag 1 is also movable in a direction along the rotation axis 1*a* (rotation axial direction).

The conveying guide 2 is provided with a light transmissive photo sensor 3. The photo sensor 3 outputs a detection signal in response to turning of the sensor flag 1 as a turning portion to a detecting position. A sensor shielding portion 1*b* of the sensor flag 1, provided at the conveying guide 2 to be rotatable centering on the rotation axis 1*a* and to be movable in the direction of the rotation axis 1*a*, is turned centering of the rotation axis 1*a* between a light emitting portion and a light receiving portion of the photo sensor 3 and shields the light path to turn ON/OFF the photo sensor 3.

The sensor flag 1 is provided with a contact portion 1*c*, which can contact the recording medium S conveyed along a guide rib 2*f* in the conveying apparatus. The recording medium S conveyed in the conveying apparatus contacts the contact portion 1*c* and presses and rotates the sensor flag 1 centering on the rotation axis 1*a*, and the shielding portion 1*b* transmits and shields light on the light path between the light emitting portion and the light receiving portion of the photo sensor 3 to turn ON/OFF the photo sensor 3. Accordingly, a passing state of the recording medium S can be detected.

The conveying guide 2, which guides conveyance of the recording medium S, is provided with a first guide surface (first sliding contact portion) 2*a* moving the sensor flag 1 in a first axial direction (arrow a direction illustrated in FIG. 4B) along the rotation axis 1*a*.

The conveying guide 2, which guides conveyance of the recording medium S, is provided with a first guide surface (first sliding contact portion) 2*a* moving the sensor flag 1 in a first axial direction (arrow a direction illustrated in FIG. 4B) along the rotation axis 1*a*.

Figure 3A:
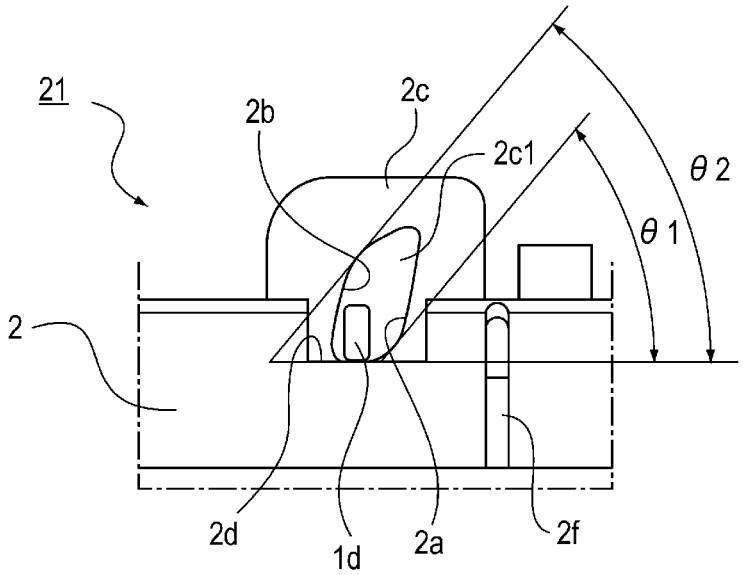
FIG. 3A is a front view illustrating a state in which a positioning abutting portion abuts on a first guide surface in a state in which a sensor flag is at a home position.
Figure 4A:
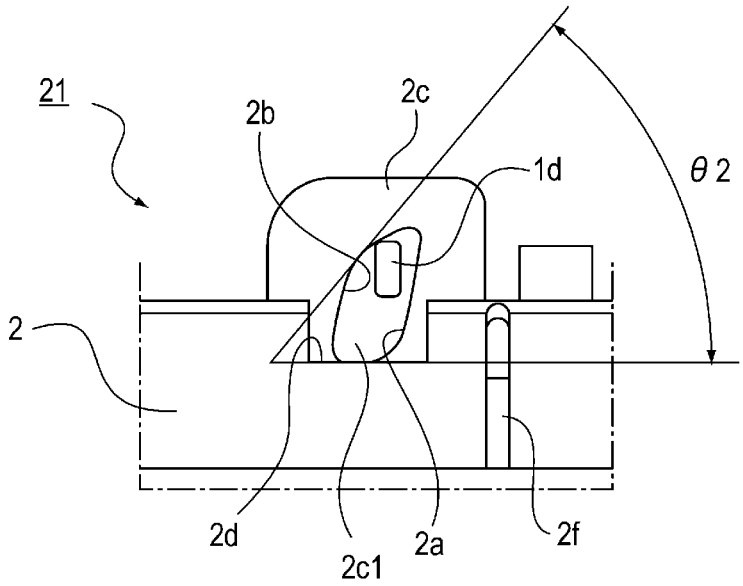
FIG. 4A is a front view illustrating a state in which the positioning abutting portion abuts on the second guide surface in a state in which the sensor flag is at the detecting position.

When the sensor flag 1 moves from the detecting position illustrated in FIG. 4A, in which the sensor flag 1 contacts the recording medium S, to a home position illustrated in FIGS. 2 and 3A, in which the sensor flag 1 does not contact the recording medium S, the sensor flag 1 slides in contact with the first guide surface 2*a*. Subsequently, the sensor flag 1 is moved in the first axial direction (arrow a direction illustrated in FIG. 4B) along the rotation axis 1*a*.

The conveying guide 2 is further provided with a second guide surface (second sliding contact portion) 2*b* moving the sensor flag 1 in a second axial direction (arrow b direction illustrated in FIG. 3B) along the rotation axis 1*a*, which is an opposite direction of the first axial direction (arrow a direction illustrated in FIG. 4B) along the rotation axis 1*a*.

When the sensor flag 1 moves from the home position illustrated in FIGS. 2 and 3A, in which the sensor flag 1 does not contact the recording medium S, to the detecting position illustrated in FIG. 4A, in which the sensor flag 1 contacts the recording medium S, the sensor flag 1 slides in contact with the second guide surface 2*b*. Subsequently, the sensor flag 1 is moved in the second axial direction (arrow b direction illustrated in FIG. 3B) along the rotation axis 1*a*, which is an opposite direction of the first axial direction (arrow a direction illustrated in FIG. 4B) along the rotation axis 1*a*.

Figure 4B:
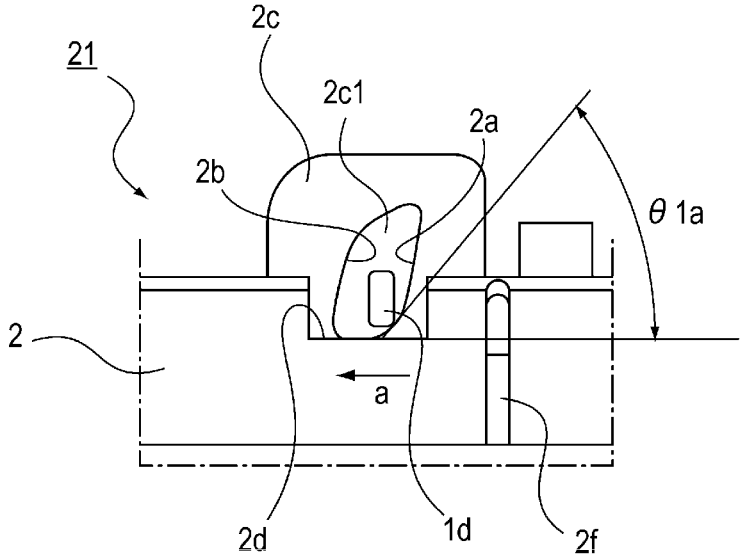
FIG. 4B is a front view illustrating a state in which the positioning abutting portion abuts on the first guide surface in a process in which the sensor flag moves from the detecting position to the home position in the first embodiment.

The first guide surface 2*a* and the second guide surface 2*b* have surfaces inclined to the direction of the rotation axis 1*a* (right-left direction in FIG. 2) of the sensor flag 1. As for the first guide surface 2*a*, an inclination angle θ1 to the rotation axial direction (right-left direction in FIG. 2) of the rotation axis 1*a* of the sensor flag 1 is set to be smaller as the sensor flag 1 moves closer to the home position. For example, an inclination angle θ1*a* illustrated in FIG. 4B is set to be larger than an inclination angle θ1*b* illustrated in FIG. 5A, at which the sensor flag 1 is closer to the home position.

Figure 5A:
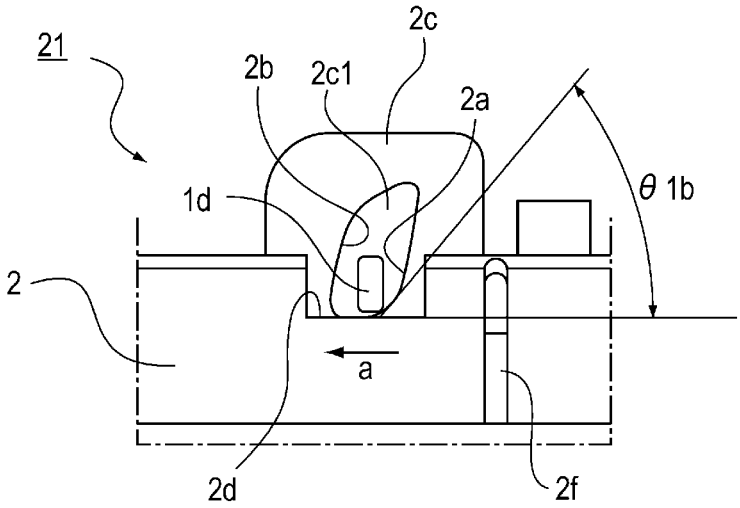
FIG. 5A is a front view illustrating a state in which the positioning abutting portion abuts on a surface, having a smaller inclination angle, of the first guide surface as the sensor flag moves closer to the home position in the process in which the sensor flag moves from the detecting position to the home position.
Figure 5B:
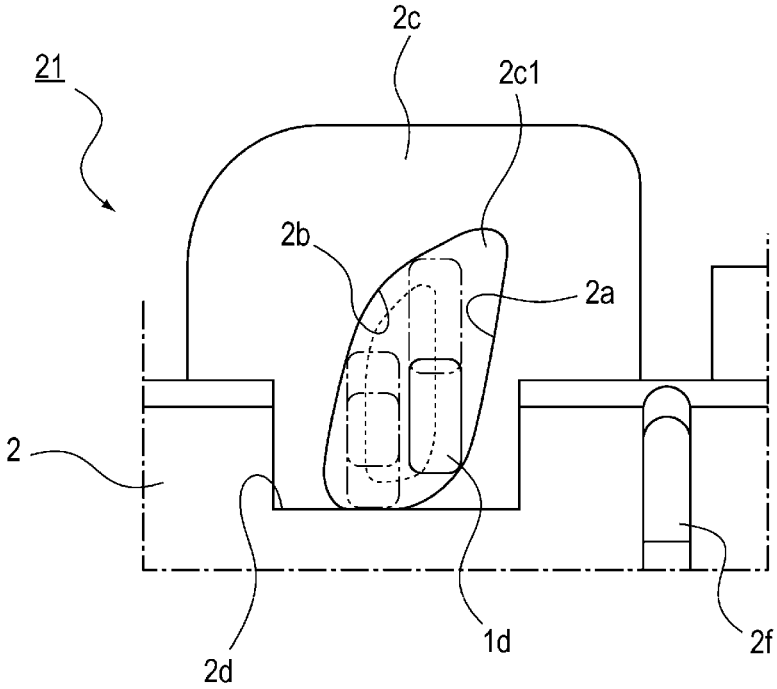
FIG. 5B is a front view illustrating a track on which the positioning abutting portion slides in contact with the first and second guide surfaces in a process in which the sensor flag moves from the home position to the detecting position and further moves to the home position in the first embodiment.

The first and second guide surfaces 2*a* and 2*b* of the present embodiment are formed by an opening edge portion of a through hole 2*c*1 formed in a shape similar to "a hysteresis curve" provided in a plate-shaped member 2*c* provided on the conveying guide 2 in an upright state and are formed by mutually continuous annular curves. The sensor flag 1 is provided with the abutting portion 1*d* as the protruded portion protruded in the radial direction. The positioning abutting portion 1*d* provided on the sensor flag 1 passes through the through hole 2*c*1 provided in the plate-shaped member 2*c* of the conveying guide 2, and the positioning abutting portion 1*d* slides along and in contact with the first and second guide surfaces 2*a* and 2*b* in the through hole 2*c*1 as illustrated in FIG. 5B.

Figure 3B:
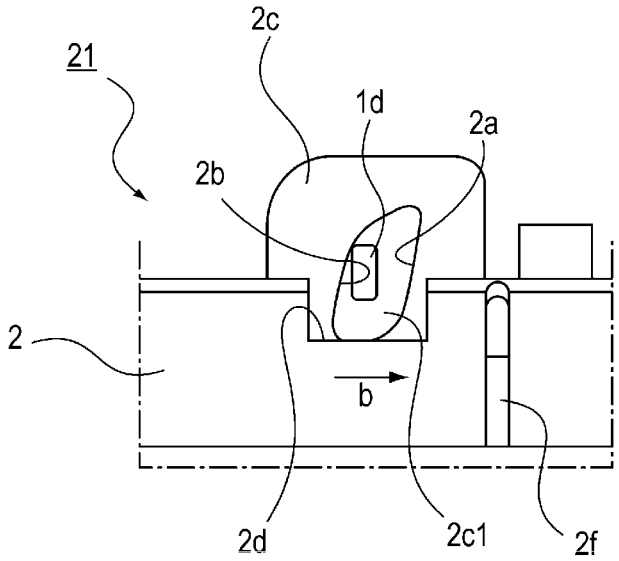
FIG. 3B is a front view illustrating a state in which the positioning abutting portion abuts on a second guide surface in a process in which the sensor flag moves from the home position to a detecting position in the first embodiment.

FIG. 3A illustrates a position of the positioning abutting portion 1*d* at the home position, in which the contact portion 1*c* of the sensor flag 1 does not slide in contact with the recording medium S. FIG. 3B illustrates a position of the positioning abutting portion 1*d* when the contact portion 1*c* of the sensor flag 1 slides in contact with the recording medium S, and when the sensor flag 1 starts to be pressed and rotated centering on the rotation axis 1*a* and is in the middle of moving from the home position to the detecting position.

Also, FIG. 4A illustrates a position of the positioning abutting portion 1*d* at the detecting position, in which the contact portion 1*c* of the sensor flag 1 slides in contact with the recording medium S. Each of FIGS. 4B and 5A illustrates a position of the positioning abutting portion 1*d* when the contact portion 1*c* of the sensor flag 1 slides in contact with the recording medium S and is in the middle of moving from the detecting position to the home position.

The first guide surface 2*a* illustrated in FIGS. 2 to 5 is formed by a curve protruded downward, and the inclination angle θ1 of the first guide surface 2*a* to the direction of the rotation axis 1*a* of the sensor flag 1 is set to be gradually smaller as the sensor flag 1 moves closer to the home position from the top to the bottom of FIG. 3A.

Also, the second guide surface 2*b* illustrated in FIGS. 2 to 5 is formed by a curve protruded upward, and an inclination angle θ2 of the second guide surface 2*b* to the direction of the rotation axis 1*a* of the sensor flag 1 is set to be gradually smaller as the sensor flag 1 moves closer to the detecting position from the bottom to the top of FIG. 4A.

Figure 6A:
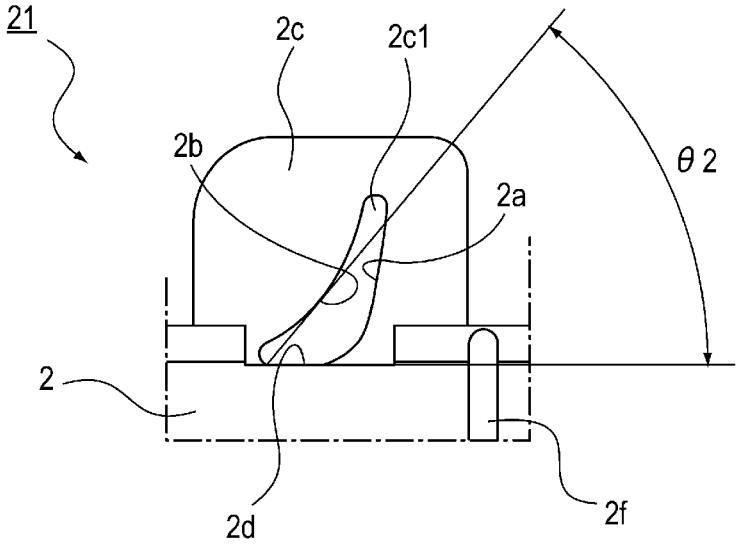
FIGS. 6A and 6B are front views illustrating examples in cases of forming the second guide surface in other shapes in the first embodiment.
Figure 6B:
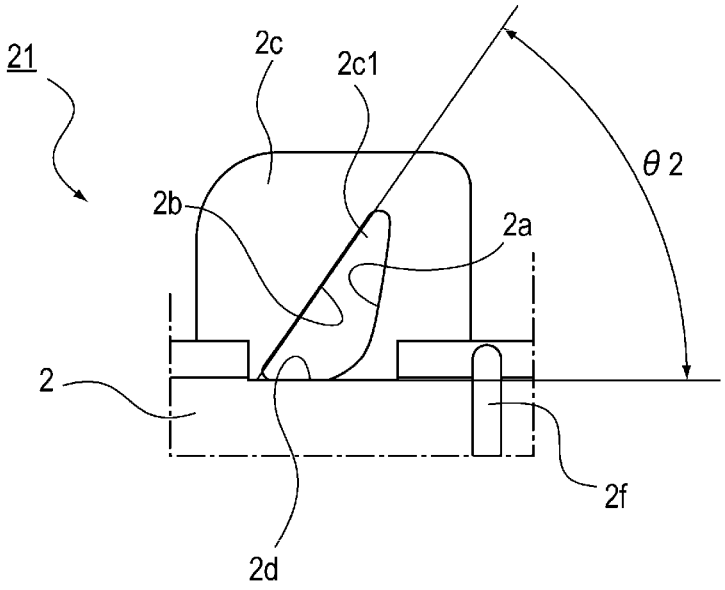

The second guide surfaces 2*b* illustrated in FIGS. 6A and 6B are examples of other configurations. The second guide surface 2*b* illustrated in FIG. 6A is formed by a curve protruded downward, and the inclination angle θ2 of the second guide surface 2*b* to the direction of the rotation axis 1*a* of the sensor flag 1 is set to be gradually larger as the sensor flag moves closer to the detecting position from the bottom to the top of FIG. 6A. The second guide surface 2*b* illustrated in FIG. 6B is linear and is an example in which the inclination angle θ2 of the second guide surface 2*b* to the direction of the rotation axis 1*a* of the sensor flag 1 is set to 55° or so. It is to be noted that the inclination angle θ2 of the second guide surface 2*b* to the direction of the rotation axis 1*a* of the sensor flag 1 is not limited to these, and the second guide surface 2*b* can be formed in a linear or curved shape having various angles.

In above description, the inclination angle θ1 of the first guide surface 2*a* to the direction of the rotation axis 1*a* of the sensor flag 1 is set to be gradually smaller as the sensor flag 1 moves closer to the home position from the top to the bottom of FIG. But the first guide surface 2*a* can be formed in a linear.

A torsion coil spring 4 is fitted to the rotation axis 1*a*, and one end portion thereof is locked by a spring holding portion 1*e* of the sensor flag 1 while the other end is locked by a part of the conveying guide 2. An elastic force by expansion of the torsion coil spring 4 is set to act in a direction opposite to a direction in which the recording medium S contacts the contact portion 1*c* of the sensor flag 1 and presses and rotates the contact portion 1*c* centering on the rotation axis 1*a* and applies a rotational load to the sensor flag 1. When the recording medium S is detached from the contact portion 1*c* of the sensor flag 1, the sensor flag 1 is rotated centering on the rotation axis 1*a* by the elastic force by expansion of the torsion coil spring 4 and returns to the home position as illustrated in FIGS. 2 and 3A.

FIG. 2 illustrate a state immediately before the recording medium S conveyed along the conveying guide 2 abuts on the contact portion 1*c* of the sensor flag 1, and a posture position of the sensor flag 1 at this time is the home position.

Thereafter, the recording medium S presses up the contact portion 1*c* of the sensor flag 1, at the same time of which the sensor shielding portion 1*b* is rotated and swung centering on the rotation axis 1*a* to switch a state of the photo sensor 3 from a light shielding state to a light transmitting state. A front end position of the recording medium S can be detected in receipt of an OFF/ON change of an electric signal of this photo sensor 3. A posture position when an electric signal of the photo sensor 3 is in an ON state is the detecting position.

Next, a position and a posture of the positioning abutting portion 1*d* in the process in which the sensor flag 1 moves from the home position illustrated in FIGS. 2 and 3A to the detecting position illustrated in FIG. 4A will be described. FIGS. 3A to 5A illustrate a moving state of the positioning abutting portion 1*d* of the sensor flag 1 and illustrate the plate-shaped member 2*c*, whose through hole 2*c*1 allows the positioning abutting portion 1*d* illustrated in FIG. 2 to pass therethrough, seen approximately from the front.

As illustrated in FIGS. 3A, 3B, and 4A, there is a process in which the positioning abutting portion 1*d* of the sensor flag 1 moves from the home position illustrated in FIGS. 2 and 3A to the detecting position illustrated in FIG. 4A. In this process, the positioning abutting portion 1*d* of the sensor flag 1 moves along the second guide surface 2*b* provided in the plate-shaped member 2*c* of the conveying guide 2 along with a rotating movement of the sensor flag 1 centering on the rotation axis 1*a*. Subsequently, the positioning abutting portion 1*d* moves in an upward direction in FIGS. 3 and 4A and in a right direction of the rotation axis 1*a* as the second axial direction (arrow b direction in FIG. 3B) and keeps in dynamic equilibrium at the detecting position illustrated in FIG. 4A.

Next, a position and a posture of the positioning abutting portion 1*d* in the process in which the sensor flag 1 moves from the detecting position illustrated in FIG. 4A to the home position illustrated in FIGS. 2 and 3A will be described.

When the recording medium S is further conveyed, and the rear end of the recording medium S passes the contact portion 1*c* of the sensor flag 1, the sensor flag 1 performs a rotating operation to the home position illustrated in FIGS. 2 and 3A by weight of the contact portion 1*c* itself and in receipt of the elastic force by expansion of the torsion coil spring 4.

At this time, as illustrated in FIGS. 4A, 4B, 5A, and 3A, the positioning abutting portion 1*d* of the sensor flag 1 moves along the first guide surface 2*a* provided in the plate-shaped member 2*c* of the conveying guide 2. The positioning abutting portion 1*d* slides on the inclined surface of the first guide surface 2*a* while moving in a downward direction in FIGS. 4B and 5A and in a left direction of the rotation axis 1*a* as the first axial direction (arrow a direction in FIGS. 4B and 5A). Subsequently, the positioning abutting portion 1*d* lands on a positioning surface 2*d* provided on the conveying guide 2 and returns to the home position illustrated in FIG. 3A.

As for an inclination of the first guide surface 2*a* provided in the through hole 2*c*1 of the plate-shaped member 2*c* of the conveying guide 2, the inclination angle θ1 can be smaller as the positioning abutting portion 1*d* moves closer to the positioning surface 2*d* as the home position as illustrated in FIGS. 4B and 5A. That is, the inclination angle θ1*b* illustrated in FIG. 5 is smaller than the inclination angle θ1*a* illustrated in FIG. 4B.

The inclination angle θ1*a* illustrated in FIG. 4B is an inclination angle of a tangent to the first guide surface 2*a* at a part at which the positioning abutting portion 1*d* abuts on the first guide surface 2*a* with respect to the direction of the rotation axis 1*a*. The inclination angle θ1*b* illustrated in FIG. 5A is an inclination angle of a tangent to the first guide surface 2*a* at a part at which the positioning abutting portion 1*d* abuts on the first guide surface 2*a* with respect to the direction of the rotation axis 1*a*.

By forming the first guide surface 2*a* in such a shape, the positioning abutting portion 1*d* slides on and frictions the first guide surface 2*a*, and a braking force acts. In addition, the positioning abutting portion 1*d* drops in a vertical direction from the position in FIG. 4A to the position in FIG. 4B. At this time, when the positioning abutting portion 1*d* collides with the first guide surface 2*a* forming an inclined surface, sound energy at the time of collision distributed in the vertical direction and in the direction of the rotation axis 1*a* can be converted into kinetic energy which moves the sensor flag 1 in the first axial direction (arrow a direction in FIG. 4B) along the rotation axis 1*a*.

Thus, chattering can be prevented, and a collision noise of the sensor flag 1 at the positioning abutting portion 1*d* can be further alleviated. Also, since the end portion of the first guide surface 2*a* is formed in an arc so that the positioning abutting portion 1*d* can move smoothly from the first guide surface 2*a* to the positioning surface 2*d*, a collision noise when the positioning abutting portion 1*d* moves in the direction of the rotation axis 1*a* can be alleviated as well.

In this manner, the positioning abutting portion 1*d* of the sensor flag 1 slides along and in contact with the first and second guide surfaces 2*a* and 2*b* formed by the circumference of the through hole 2*c*1 of the plate-shaped member 2*c* of the conveying guide 2 and the positioning surface 2*d* of the conveying guide 2. Thus, the positioning abutting portion 1*d* follows the track as illustrated in FIG. 5B. At the time of moving from the detecting position illustrated in FIG. 4A to the home position illustrated in FIG. 3A, the positioning abutting portion 1*d* can definitely start abutting on the inclined surface of the first guide surface 2*a*.

Also, as for the shape of the second guide surface 2*b* guiding the positioning abutting portion 1*d* of the sensor flag 1, the second guide surface 2*b* can be a curve protruded downward or be formed by a straight line having a relatively large inclination angle θ2 as illustrated in FIGS. 6A and 6B. This can reduce a load to cause the sensor flag 1 in the dynamic equilibrium state to move in the direction of the rotation axis 1*a* as much as possible.

Especially during sheet passing in which the recording medium S contacts the contact portion 1*c* of the sensor flag 1, the load to cause the sensor flag 1 in the dynamic equilibrium state as illustrated in FIG. 4A to move in the direction of the rotation axis 1*a* is reduced as much as possible. Thus, followability of the sensor flag 1 for the recording medium S can be improved.

It is to be noted that, although the above embodiment is configured to apply the elastic force of the torsion coil spring 4 at the time of returning the sensor flag 1 to the home position, the embodiment may be configured to omit the torsion coil spring 4 and return the sensor flag 1 to the home position by self weight balance of the contact portion 1*c*.

Figure 11:
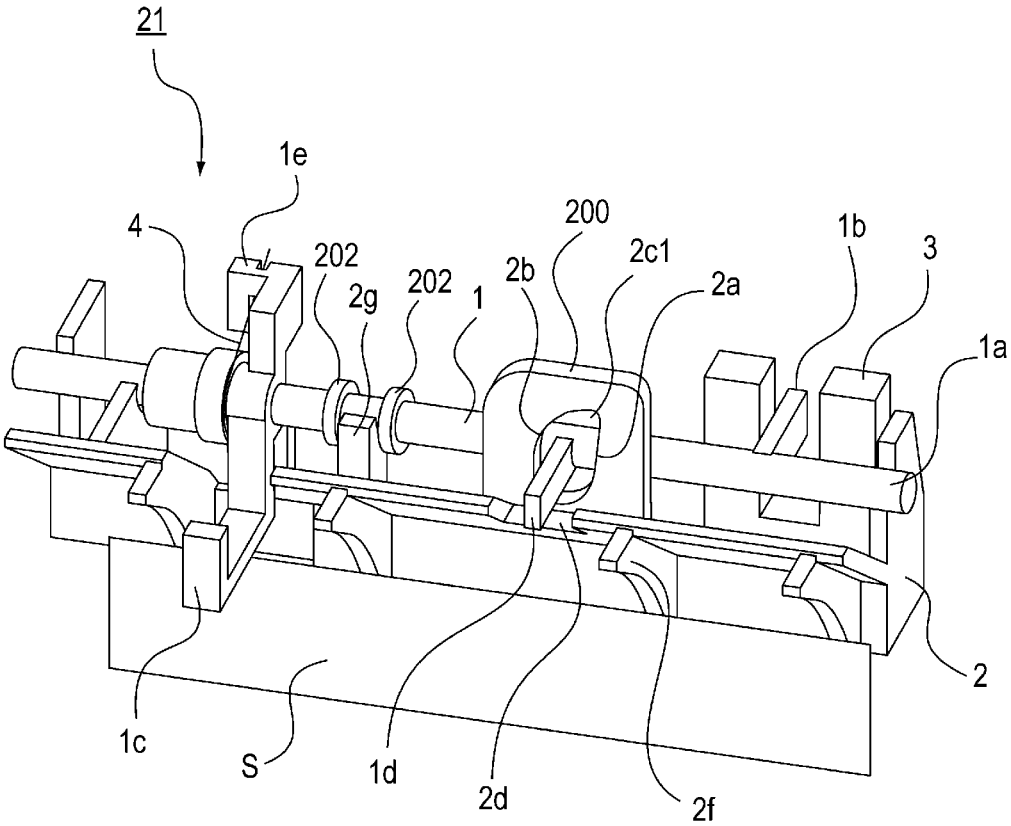
FIG. 11 is a perspective view illustrating a modification example of the first embodiment.

Also, although the sensor flag 1 is provided to be movable in the direction of the rotation axis 1*a* in the above embodiment, the sensor flag 1 may be fixed in the direction of the rotation axis 1*a*, and a plate-shaped member 200, on which the first guide surface 2*a* and the second guide surface 2*b* are formed, may be provided in the apparatus main body to be slidable in the direction of the rotation axis 1*a*. FIG. 11 is a perspective view illustrating a configuration of such a modification example, and FIG. 12 illustrates operations in this modification example. In FIGS. 11 and 12, identical components to those in the above first embodiment are illustrated with the same reference numerals, and description of the duplicate components will not be repeated.

The movement of the sensor flag 1 is regulated so that the sensor flag 1 may be prevented from moving in the direction of the rotation axis 1*a* by a regulating portion 202 provided at the rotation axis 1*a* and a positional regulating member 2*g* provided at the conveying guide 2. The plate-shaped member 200, on which the first guide surface 2*a* and the second guide surface 2*b* are formed, is provided in the apparatus main body to be slidable in the direction of the rotation axis 1*a* by a not illustrated moving portion.

Figure 12A:
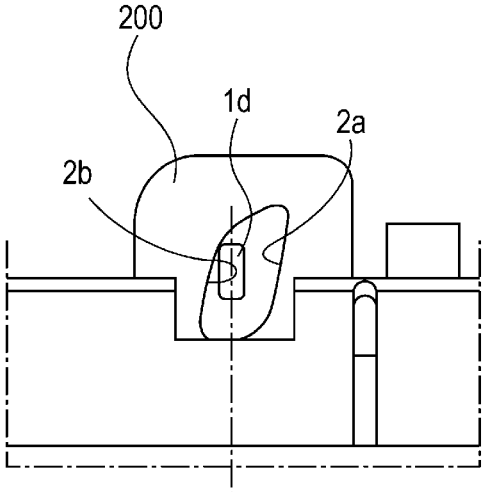
FIG. 12A is a schematic view illustrating a configuration of the modification example illustrated in FIG. 11 in a state in which the sensor flag is at the home position.
Figure 12B:
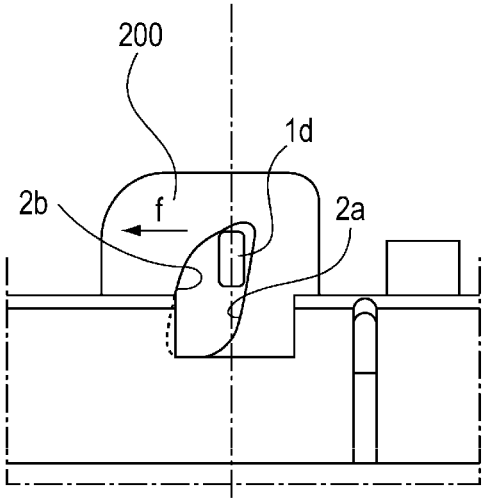
FIG. 12B is a schematic view illustrating a state in which the sensor flag is turning from the home position to the detecting position in the modification example illustrated in FIG. 11.

FIG. 12A illustrates a state in which the sensor flag 1 is located at the home position. When the sensor flag 1 is pressed by the recording medium S and is turned from the home position, the positioning abutting portion 1*d* of the sensor flag 1 slides in contact with the second guide surface 2*b*, and along with turning of the sensor flag 1, the plate-shaped member 200 moves in the arrow f direction in FIG. 12B along the direction of the rotation axis 1*a*.

Figure 12C:
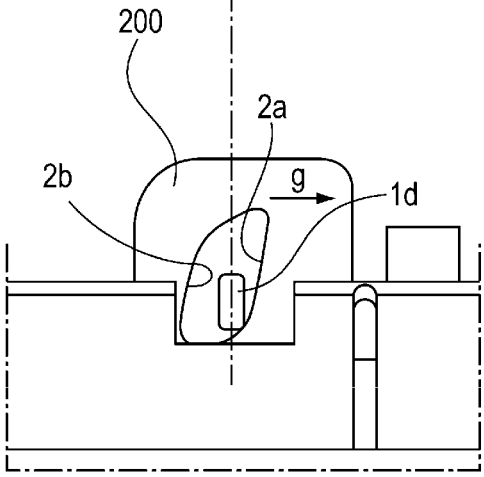
FIG. 12C is a schematic view illustrating a state in which the sensor flag is turning from the detecting position to the home position in the modification example illustrated in FIG. 11.
Figure 13A:
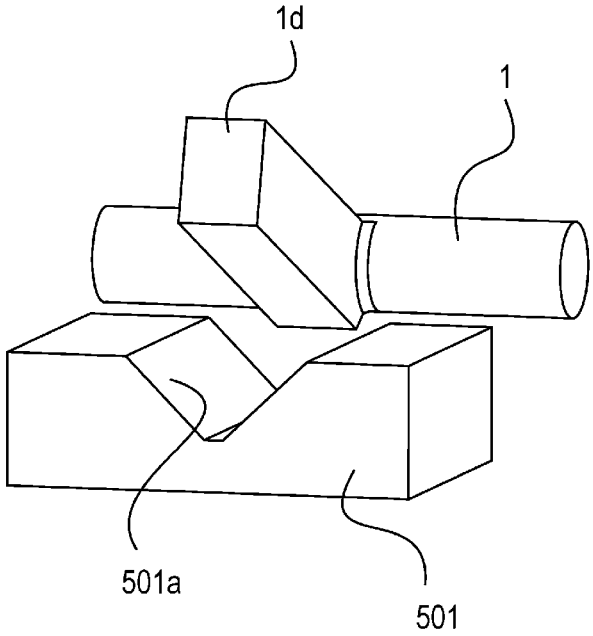
FIG. 13A PRIOR ART
FIG. 13 illustrates a conventional example.
Figure 13B:
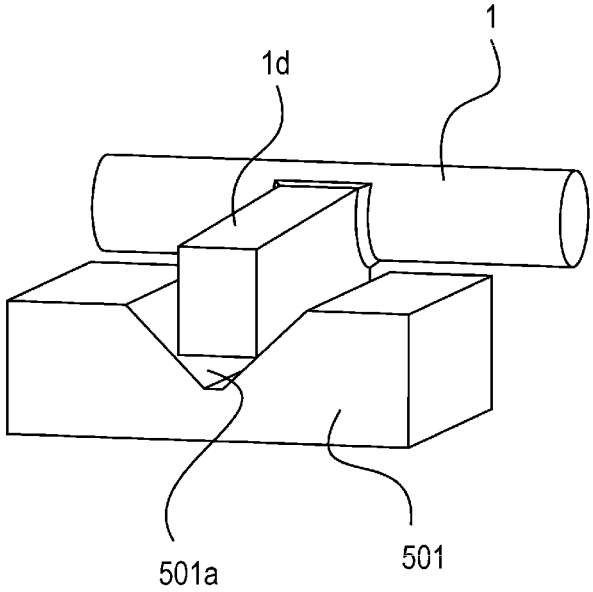
FIG. 13B PRIOR ART

Also, when the recording medium S passes the sensor flag 1 to cause the sensor flag 1 to return from the detecting position to the home position, the positioning abutting portion 1*d* slides in contact with the first guide surface 2*a*, and along with turning of the sensor flag 1, the plate-shaped member 200 moves in the arrow g direction in FIG. 12C along the direction of the rotation axis 1*a* and returns to the home position illustrated in FIG. 12A.

[Second Embodiment]

Next, a second embodiment of an image forming apparatus having a sheet detecting apparatus according to the present invention will be described with reference to FIGS. 7 and 8. It is to be noted that similar components to those in the above first embodiment are illustrated with the same reference numerals, and description of the duplicate components will not be repeated.

In the aforementioned first embodiment, the positioning abutting portion 1*d* of the sensor flag 1 slides in contact with the second guide surface 2*b* and moves. Thus, when the sensor flag 1 moves from the home position illustrated in FIG. 3A to the detecting position illustrated in FIG. 4A, the sensor flag 1 is moved in the second axial direction (arrow b direction in FIG. 3B) along the rotation axis 1*a*. The present embodiment shows an example of a thrusting member thrusting the sensor flag 1 in the second axial direction (arrow b direction in FIG. 7A) along the rotation axis 1*a*.

In this example, an inclined surface 1*f*1 of a positional approximating member if provided on the sensor flag 1 on the opposite side of the contact portion 1*c* centering on the rotation axis 1*a* and an inclined surface 2*e*1 of a thrusting member 2*e* standing up from the conveying guide 2 abut and slide on each other. When the sensor flag 1 is rotated centering on the rotation axis 1*a* and moves from the home position illustrated in FIG. 7A to the detecting position illustrated in FIG. 8A, the sensor flag 1 is moved in the second axial direction (arrow b direction in FIG. 7A) along the rotation axis 1*a*. In the present embodiment, the positioning abutting portion 1*d* and the positional approximating member if are provided on the sensor flag 1 and are protruded portions protruded in the radial direction of the sensor flag 1.

Figure 7A:
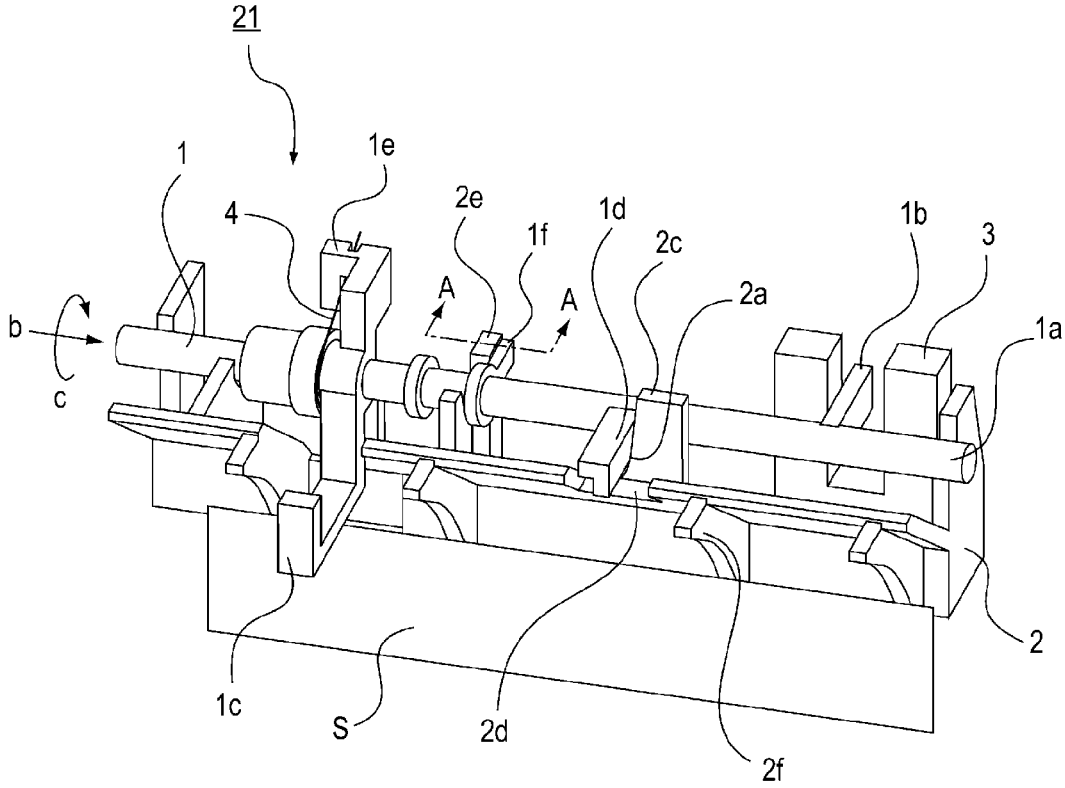
FIG. 7A is a perspective view illustrating a configuration of a second embodiment of the sheet detecting apparatus according to the present invention in a state in which the sensor flag is at the home position.
Figure 7B:
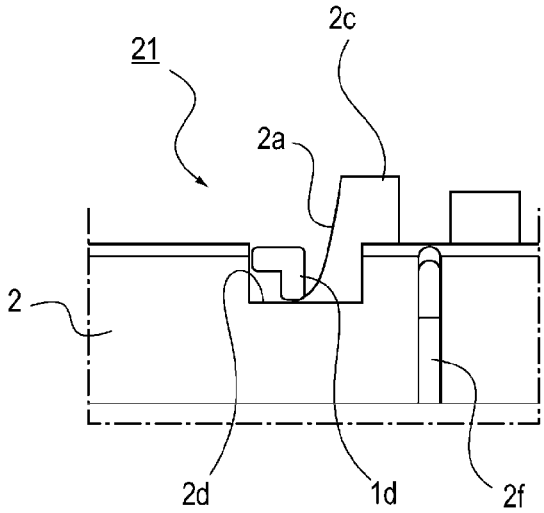
FIG. 7B is a front view illustrating a state in which the positioning abutting portion of the sensor flag abuts on a positioning surface in a state of being at the home position.
Figure 7C:
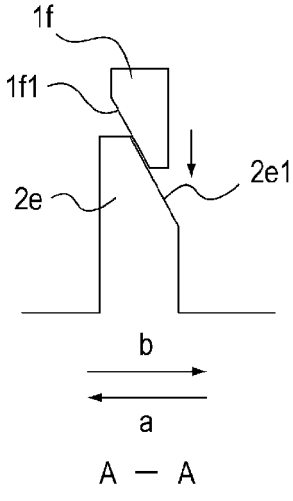
FIG. 7C is a schematic cross-sectional view illustrating a configuration in a state in which a positional approximating member thrusting the sensor flag in a second axial direction is at the home position.

That is, the recording medium S contacts the contact portion 1*c* of the sensor flag 1 from the home position illustrated in FIG. 7A and presses and rotates the sensor flag 1 centering on the rotation axis 1*a* in the arrow c direction in FIG. 7A. The positional approximating member 1*f*, which turns integrally with the sensor flag 1, is then lowered from the uppermost position illustrated in FIGS. 7A and 7C. At this time, as illustrated in FIG. 7C, the inclined surface 1*f*1 of the positional approximating member if abuts and slides on the inclined surface 2*e*1 of the thrusting member 2*e* standing up from the conveying guide 2 and is lowered obliquely downward in the arrow b direction in FIG. 7C along the inclined surface 2*e*1. Accordingly, the sensor flag 1 moves in the arrow b direction in FIG. 7A as the second axial direction along the rotation axis 1*a*.

Figure 8A:
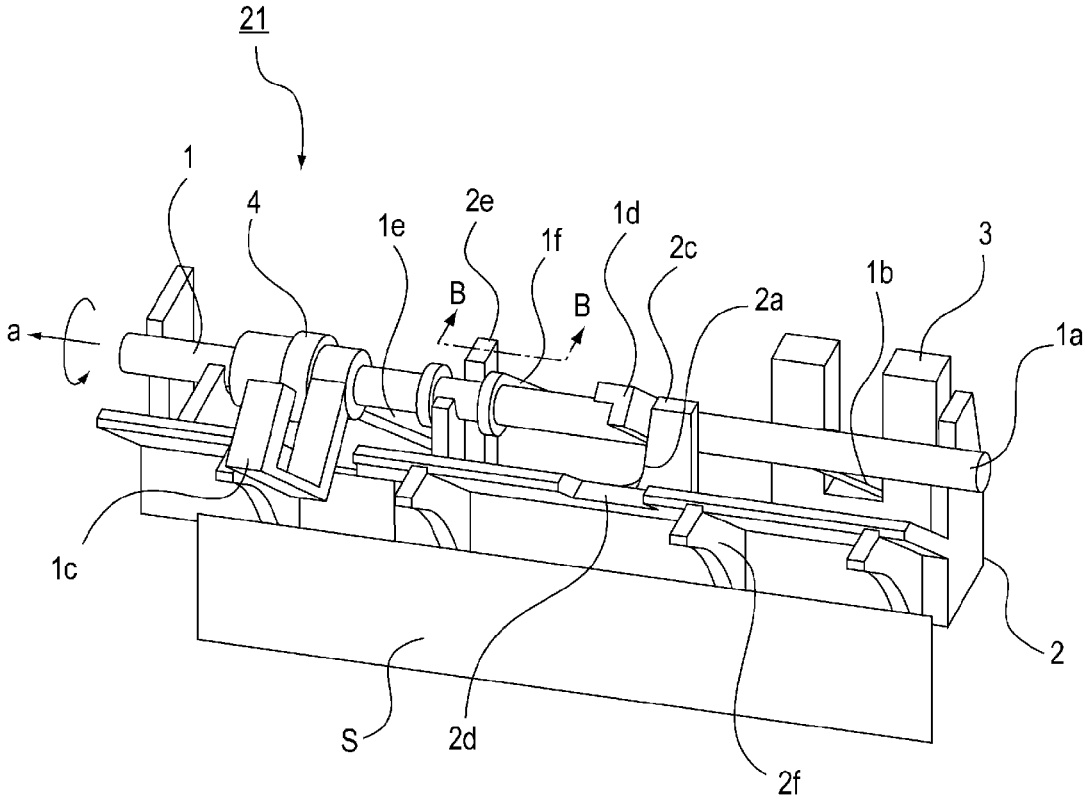
FIG. 8A is a perspective view illustrating a configuration of the second embodiment of the sheet detecting apparatus according to the present invention in a state in which the sensor flag is at the detecting position.
Figure 8B:
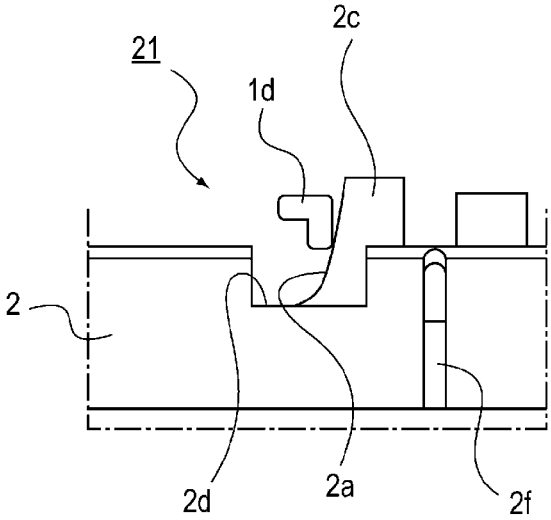
FIG. 8B is a front view illustrating a state in which the positioning abutting portion of the sensor flag abuts on the first guide surface in a state of being at the detecting position.

FIG. 8A illustrates a state in which the sensor flag 1 has been rotated to the detecting position. When the recording medium S is further conveyed, and the rear end of the recording medium S passes the contact portion 1*c* of the sensor flag 1, the sensor flag 1 performs a rotating operation to the home position illustrated in FIG. 7A by weight of the contact portion 1*c* itself and in receipt of the elastic force by expansion of the torsion coil spring 4.

At this time, as illustrated in FIG. 8A, while the positioning abutting portion 1*d* of the sensor flag 1 moves along the first guide surface 2*a* provided in the plate-shaped member 2*c* of the conveying guide 2, the positioning abutting portion (a first protrusion) 1*d* moves in a downward direction in FIG. 8A and in a left direction of the rotation axis 1*a* as the first axial direction (arrow a direction in FIG. 8A). Subsequently, the positioning abutting portion 1*d* slides on the inclined surface of the first guide surface 2*a*, lands on the positioning surface 2*d* provided on the conveying guide 2, and returns to the home position illustrated in FIG. 7A.

Meanwhile, in the aforementioned first embodiment, the through hole 2*c*1 is provided in the inside of the plate-shaped member 2*c*, and a circumference thereof is made into the first guide surface 2*a* and the second guide surface 2*b*. In the present embodiment, one side edge of the plate-shaped member 2*c* is formed as the first guide surface 2*a* having a surface inclined to the direction of the rotation axis 1*a* in a similar manner to that of the aforementioned first embodiment. The inclination angle θ1 of the first guide surface 2*a* of the present embodiment is also set to be smaller as the positioning abutting portion 1*d* moves closer to the home position.

Figure 8C:
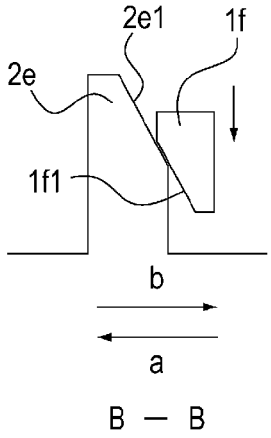
FIG. 8C is a schematic cross-sectional view illustrating a configuration in a state in which the positional approximating member thrusting the sensor flag in the second axial direction is at the detecting position.

The positional approximating member (a second protrusion) 1*f*, which turns integrally with the sensor flag 1, is raised from the lowermost position illustrated in FIG. 8C. At this time, the inclined surface 1*f*1 of the positional approximating member if abuts and slides on the inclined surface 2*e*1 of the thrusting member 2*e* standing up from the conveying guide 2 and is raised obliquely upward in the arrow a direction in FIG. 8C along the inclined surface 2*e*1. Accordingly, the sensor flag 1 moves in the arrow a direction in FIG. 8A as the first axial direction along the rotation axis 1*a* and returns to the home position illustrated in FIG. 7A.

In the present embodiment, the sensor flag 1 moves from the home position illustrated in FIG. 7A to the detecting position illustrated in FIG. 8A. At this time, the sensor flag 1 is moved in the second axial direction (arrow b direction in FIG. 7A) along the rotation axis 1*a*. To do so, the present embodiment is configured so that the inclined surface 1*f*1 of the positional approximating member if provided in the sensor flag 1 may abut and slide on the inclined surface 2*e*1 of the thrusting member 2*e* provided in the conveying guide 2 to cause the positional approximating member if to move obliquely.

The sensor flag 1 moves from the detecting position illustrated in FIG. 8A to the home position illustrated in FIG. 7A. At this time, the sensor flag is moved in the first axial direction (arrow a direction in FIG. 8A) along the rotation axis 1*a*. To do so, the present embodiment is configured so that the positioning abutting portion 1*d* provided in the sensor flag 1 may slide and move in contact with the first guide surface 2*a* of the plate-shaped member 2*c* provided in the conveying guide 2.

Although a configuration in which the inclined surface 2*e*1 of the thrusting member 2*e* and the inclined surface 1*f*1 of the positional approximating member if slide in contact with each other is taken as an example, a part of the positional approximating member if which slides in contact with the inclined surface 2*e*1 of the thrusting member 2*e* may not be inclined. Also, although a configuration in which the first guide surface 2*a* formed in the plate-shaped member 2*c* inclined to the direction of the rotation axis 1*a* and the positioning abutting portion 1*d* slide in contact with each other is taken as an example, a part inclined to the direction of the rotation axis 1*a* may be provided in the positioning abutting portion 1*d* of the sensor flag 1, and a part of the plate-shaped member 2*c* which contacts the positioning abutting portion 1*d* may not be inclined.

In this manner, the present embodiment is configured to separate the configurations to move the sensor flag 1 in the first and second axial directions along the rotation axis 1*a*. Even in a case where a moving portion of the sensor flag 1 in the direction of the rotation axis 1*a* is separated, a similar effect can be exerted. Other configurations are similar to those in the aforementioned first embodiment and can exert similar effects.

[Reference Example]

Next, a reference example of an image forming apparatus having a sheet detecting apparatus will be described with reference to FIG. 9. It is to be noted that similar components to those in the above embodiments are illustrated with the same reference numerals, and description of the duplicate components will not be repeated. In the present reference example, the sensor flag 1 moves from the home position illustrated in FIG. 9A to the detecting position illustrated in FIG. 9B. The present reference example is provided with a thrusting member thrusting the sensor flag 1 in the arrow b direction in FIG. 9A (second axial direction) along the rotation axis 1*a* at the time of moving from the home position to the detecting position. The thrusting member is formed with use of a thrusting force of a compression spring 5, which is locked by a part of the conveying guide 2 at one end thereof and is slidably brought into pressure contact with a part of the sensor flag 1 at the other end thereof.

The thrusting force of the compression spring 5 is controlled to have a minor value not to prevent turning of the sensor flag 1. An example of the compression spring 5 can be formed by externally covering the rotation axis 1*a* with a coiled spring, locking one end of the coiled spring at a part of the conveying guide 2, and making the other end abut on a flange member provided in the rotation axis 1*a*.

Figure 9A:
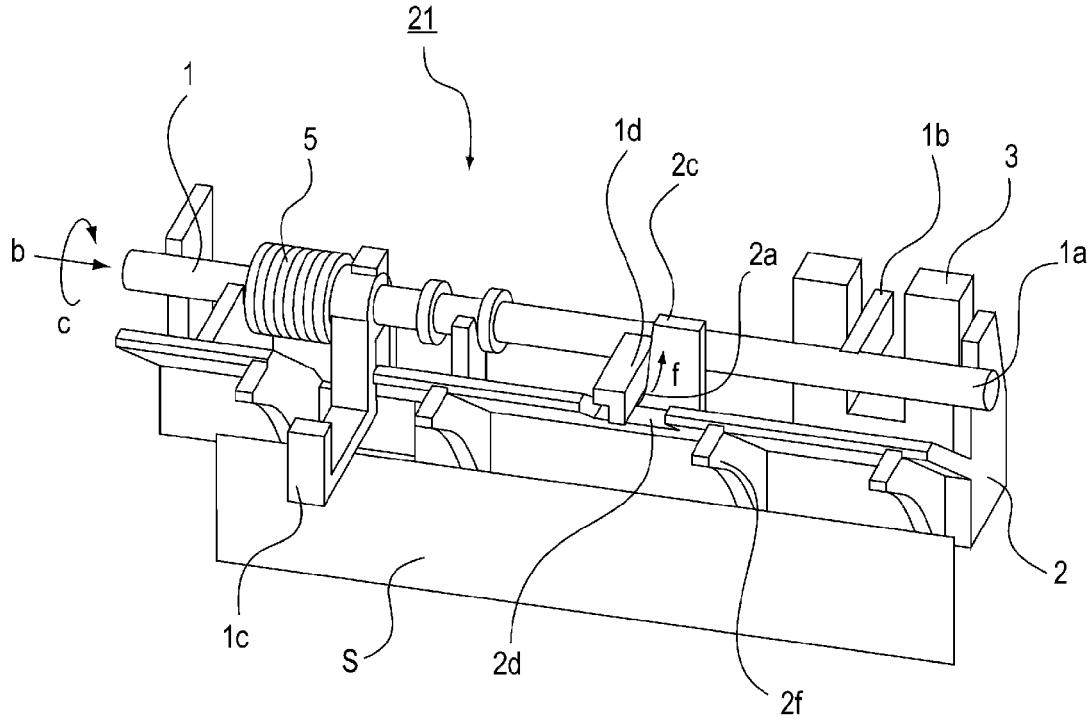
FIGS. 9A and 9B are perspective views illustrating configurations of a reference example of the sheet detecting apparatus.
Figure 9B:
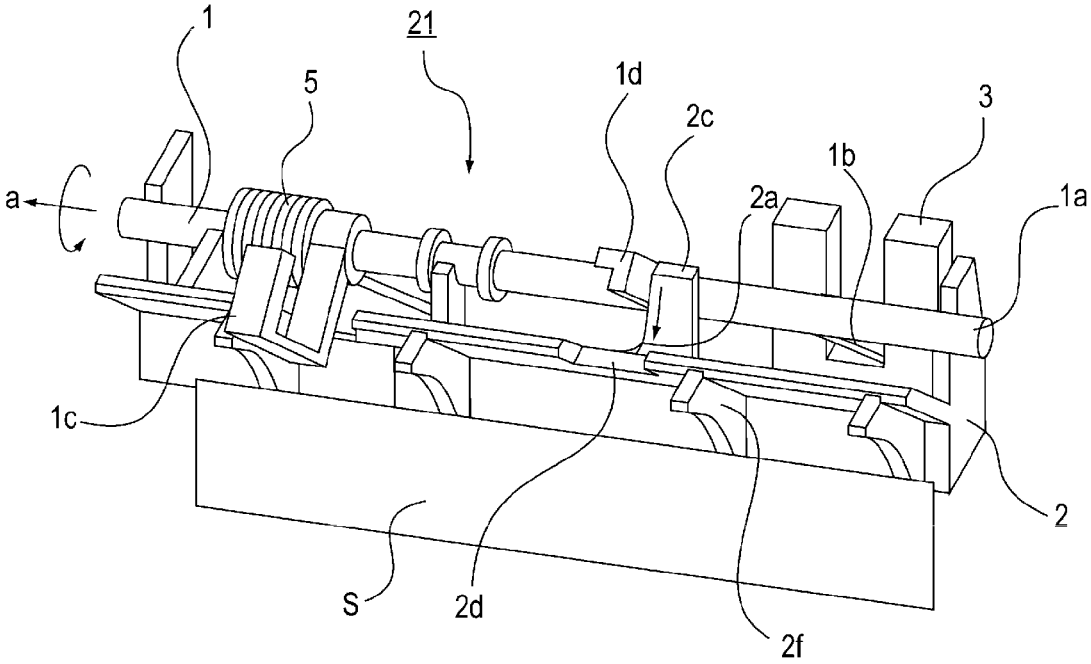

FIG. 9A illustrates a state in which the sensor flag 1 at the home position is thrust in the arrow b direction in FIG. 9A (second axial direction) by the thrusting force of the compression spring 5, and in which the positioning abutting portion 1*d* always receives a force in the right direction in FIG. 9A toward the first guide surface 2*a* of the plate-shaped member 2*c* provided in the conveying guide 2.

Thereafter, the recording medium S is conveyed upward in FIG. 9A along the guide rib 2*f* of the conveying guide 2. Subsequently, at the same time as the contact portion 1*c* is pressed up, the positioning abutting portion 1*d* of the sensor flag 1 receives a force of the compression spring 5 and moves in the arrow f direction in FIG. 9A (upper right direction in FIG. 9A) along the first guide surface 2*a*.

When the recording medium S is further conveyed, and the rear end of the recording medium S passes the contact portion 1*c*, the positioning abutting portion 1*d* of the sensor flag 1 slides along and in contact with the first guide surface 2*a* by weight of the contact portion 1*c* itself and heads for the home position illustrated in FIG. 9A.

In this manner, since the positioning abutting portion 1*d* of the sensor flag 1 slides along and in contact with the first guide surface 2*a* and always receives the thrusting force of the compression spring 5, chattering can be prevented, and a collision noise of the sensor flag 1 at the positioning abutting portion 1*d* can be alleviated drastically.

Figure 10:
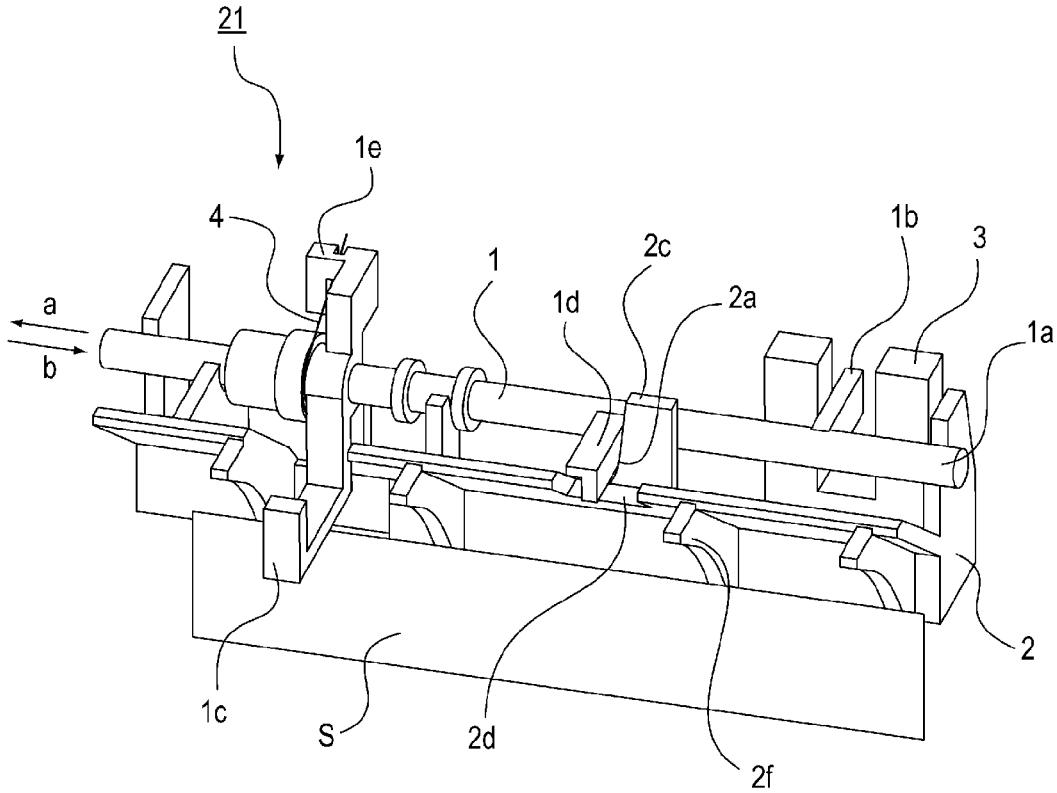
FIG. 10 is a perspective view illustrating another configuration of the reference example of the sheet detecting apparatus.

Meanwhile, instead of the compression spring 5, the torsion coil spring 4 is arranged obliquely to the direction of the rotation axis 1*a* of the sensor flag 1 as illustrated in FIG. 10. That is, positions of one end and the other end of the torsion coil spring 4 receiving applied forces are arranged to be displaced in the axial direction. Especially, the positions are arranged so that the distance in the axial direction between one end and the other end of the torsion coil spring 4 may be longer than the height of the torsion coil spring 4. By doing so, the elastic force by expansion of the torsion coil spring 4 acts in the direction of the rotation axis 1*a* as well, and thus a similar effect to that of the aforementioned compression spring 5 can be exerted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-039354, filed Feb. 25, 2011, which is hereby incorporated by reference herein in its entirety.

What is claimed is:

1. A sheet detecting apparatus comprising:

a turning portion turning from a home position to a detecting position by a contact portion being pressed by a conveyed sheet, said turning portion having a protruded portion protruded in a radial direction;

a sensor outputting a detection signal in response to the turning of the turning portion to the detecting position;

a first sliding contact portion sliding in contact with the protruded portion so as to move relatively to the protruded portion in an axial direction of the turning portion when the turning portion returns from the detecting position to the home position; and a second sliding contact portion sliding in contact with the protruded portion so as to move relatively to the protruded portion in the axial direction of the turning portion when the turning portion turns from the home position to the detecting position.

2. The sheet detecting apparatus according to claim 1, wherein the turning portion is movable in the axial direction, and the first sliding contact portion and the second sliding contact portion have surfaces inclined to the axial direction, wherein, when the turning portion moves from the detecting position to the home position, the first sliding contact portion slides with the protruded portion to cause the turning portion to move in a first axial direction, and wherein, when the turning portion moves from the home position to the detecting position, the second sliding contact portion slides with the protruded portion to cause the turning portion to move in a second axial direction, which is an opposite direction of the first axial direction.

3. The sheet detecting apparatus according to claim 2, wherein the protruded portion has a first protrusion that contacts with the first sliding contact portion and a second protrusion that contacts with the second sliding contact portion.

4. The sheet detecting apparatus according to claim 1, wherein an inclination angle of the first sliding contact portion to the axial direction is formed to be smaller as the turning portion moves closer to the home position.

5. An image forming apparatus comprising:

an image forming portion forming an image on a sheet; and the sheet detecting apparatus according to claim 1 detecting the sheet on which the image is formed by the image forming portion.

6. The image forming apparatus according to claim 5, wherein the turning portion is movable in the axial direction, and the first sliding contact portion and the second sliding contact portion have surfaces inclined to the axial direction, wherein, when the turning portion moves from the detecting position to the home position, the first sliding contact portion slides with the protruded portion to cause the turning portion to move in a first axial direction, and wherein, when the turning portion moves from the home position to the detecting position, the second sliding contact portion slides with the protruded portion to cause the turning portion to move in a second axial direction, which is an opposite direction of the first axial direction.

7. The sheet detecting apparatus according to claim 6, wherein the protruded portion has a first protrusion that contacts with the first sliding contact portion and a second protrusion that contacts with the second sliding contact portion.

8. The image forming apparatus according to claim 6, wherein an inclination angle of the first sliding contact portion to the axial direction is formed to be smaller as the turning portion moves closer to the home position.

* * * * *